United States Patent [19]

Zimmerman et al.

[11] Patent Number: 4,586,115

[45] Date of Patent: Apr. 29, 1986

[54] ELECTROMAGNETIC RADIO FREQUENCY EXCITED EXPLOSION PROOF LIGHTING METHOD AND SYSTEM

[76] Inventors: S. Mort Zimmerman, 13626 Neutron Rd., Dallas, Tex. 75234; Joseph Broz, 1228 15th St., Suite 306, The Granite Building, Denver, Colo. 80202

[21] Appl. No.: 597,672

[22] Filed: Apr. 6, 1984

[51] Int. Cl.[4] ..... F21S 3/02

[52] U.S. Cl. ..... 362/217; 362/223; 362/260; 315/39; 315/248

[58] Field of Search ..... 362/217, 223, 225, 260, 362/267; 315/39, 248; 313/485

[56] References Cited

U.S. PATENT DOCUMENTS

| | | | |
|---|---|---|---|
| 2,488,169 | 11/1949 | Browner | 315/248 |
| 2,993,973 | 7/1961 | Johnson et al. | 315/248 |
| 3,500,118 | 3/1970 | Anderson | 315/248 |
| 3,911,318 | 10/1975 | Spero et al. | 315/39 |

*Primary Examiner*—William A. Cuchlinski, Jr.
*Attorney, Agent, or Firm*—Peter J. Murphy

[57] ABSTRACT

For illuminating an area of a structure which is prone to explosion due to dust or vapors in the atmosphere, a system includes fluorescent type lighting devices which are energized by radio frequency energy without any physical connection to the lighting devices. The lighting devices include sealed envelopes having fluorescent material on the inner wall surfaces, and containing a gas which responds to external radio frequency electromagnetic radiation to excite the fluorescent material and produce visible light. The lighting devices are mounted within the structure by insulating brackets and may be mounted within impact resistant protective enclosures. The lighting devices are energized by radiating devices of electromagnetic energy which are mounted adjacent to the several lighting devices within the explosion prone area, and which are supplied with radio frequency electromagnetic energy through appropriate means from a generating source remote from or outside of the explosion prone area. The radiating devices may be metal rod antennas supplied with energy through a coaxial cable conduit. To utilize higher frequency energy, the radiating devices may be resonant horns or radiating disks connected to waveguide conduit which transmits the energy into the explosion prone area. The transmission conduit and radiating devices may be suitably insulated with rugged unbreakable solid plastic, virtually eliminating the possibility of flame, spark or heat to trigger an explosion.

24 Claims, 6 Drawing Figures

ELECTROMAGNETIC RADIO FREQUENCY EXCITED EXPLOSION PROOF LIGHTING METHOD AND SYSTEM

This invention relates to illumination in explosion prone environments, and more particularly to lighting means which virtually eliminates the possibility of a spark, flame, or heat trigger of an explosion in an explosion prone environment or area.

This invention is concerned with providing illumination in explosion prone areas which are understood to be areas of a structure for example which, because of their intended use, inherently have an atmosphere which is explosive and in which an explosion may be triggered readily by a flame, a spark, or intense heat.

One such explosion prone area may be the interior of a large storage tank for petroleum products. In such tanks, when full or partially full, there is an area at the top of the tank including a mixture of petroleum vapors and air which may be explosive. It is necessary to inspect these tanks from time to time to learn of the presence of contaminants such as animal bodies, and adequate illumination is necessary for this purpose.

Another example of an explosion prone area is a grain elevator where fine dust is always present and which may be very explosive. It is necessary to inspect grain from time to time to guard against deterioration of the grain from insects, fungus, etc.

Still another example of an explosion prone area is a paint shop, particularly those where the atmosphere must be very carefully controlled to eliminate dust, etc. Adequate illumination is especially important in such areas to assure the quality of the work.

It would be very desirable, for explosion prone illumination areas such as these, to be able to provide either permanent or portable lighting in which the possibility of an explosion triggering flame or spark or heat source is substantially eliminated. This is desirable, of course, not only from the standpoint of personnel who must work in these explosion prone environments, but also from the standpoint of protection against large capital losses due to explosion and resulting fire.

A principal object of this invention, therefore, is to provide lighting for an explosion prone area in which the possibility of explosion triggered by the lighting system is substantially eliminated.

Another object of this invention is to provide such lighting utilizing sealed gas filled tubes having an inner coating of a fluorescent material, and enclosing a gas which is activated by exterior radio frequency energy to cause the fluorescent material to radiate visible light.

A further object of this invention is to provide such lighting wherein the illumination is provided by fluorescent tubes energized by radio frequency energy without a direct conductive connection between the energy source and the fluorescent tube.

Still another object of this invention is to provide such lighting wherein the lighting devices may be energized by radio frequency energy ranging from high frequency energy to superhigh frequency energy.

A still further object of this invention is to provide such lighting wherein radio frequency energy for illuminating devices within the explosion prone area is generated outside of that explosion prone area and transmitted to the lighting devices through suitable insulated conduits.

Another object of this invention is to provide such lighting including a plurality of fluorescent lighting devices responsive to radio frequency electromagnetic radiation, and a radiating antenna associated with each of those lighting devices energized from a source of radio frequency electromagnetic energy exterior to the explosion prone area.

These objects are accomplished in a method which includes the following steps. Lighting devices are fabricated each of which includes a sealed envelope having fluorescent material on the inner wall thereof, the envelope containing a gas which is responsive to radio frequency electromagnetic radiation to activate the fluorescent material. One or more of these lighting devices are placed in the explosion prone area. Radio frequency energy is generated at a location remote from or exterior to the explosion prone area and transmitted into the explosion prone area through suitable insulated conduits. Radiation devices for radio frequency electromagnetic energy are connected to the conduit within the explosion prone area for association with each of the lighting devices.

These objects are also accomplished in a system which includes the following components. One or more lighting devices are placed within the explosion prone area, each lighting device including a sealed transparent envelope having a fluorescent material on its interior wall surfaces and containing a gas responsive to radio frequency electromagnetic radiation to activate the fluorescent material. A generating means for generating radio frequency energy is located outside or remote from the explosion prone area. Insulated transmission means transmits the radio frequency energy into the explosion prone area. One or more radiating devices are connected to the transmission means within the explosion prone area in relation to each of the lighting devices to irradiate each of the lighting devices with radio frequency electromagnetic radiation.

The novel features and the advantages of the invention, as well as additional objects thereof, will be understood more fully from the following description when read in connection with the accompanying drawings.

DRAWINGS

DESCRIPTION OF THE PREFERRED EMBODIMENTS

Figure 1:
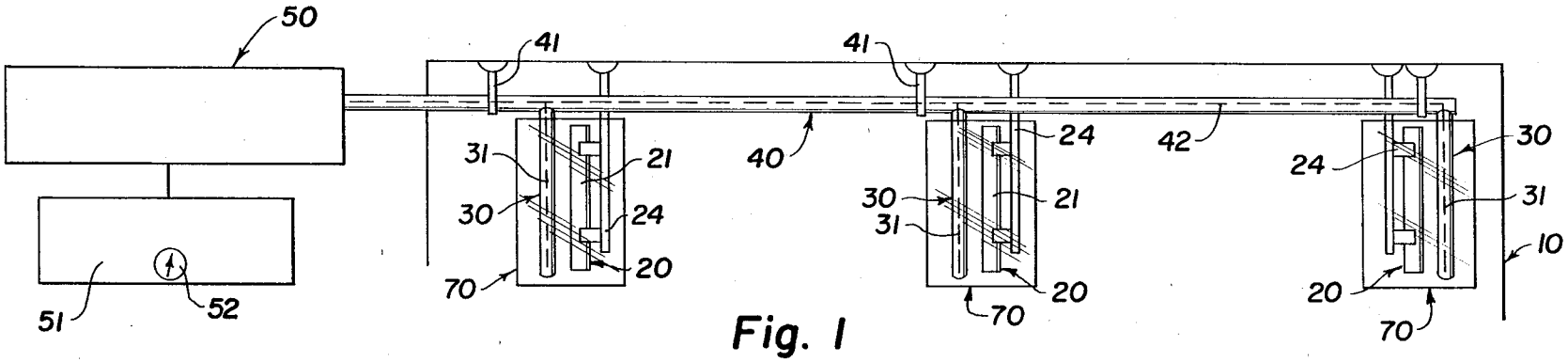
FIG. 1 is a diagrammatic illustration of one form of lighting system according to the invention.

FIGS. 1 through 4 of the drawing are concerned with one form of system according to the invention in which electromagnetic energy is transmitted into an explosion prone area by means of a coaxial cable conduit. In FIG. 1, an explosion prone area is indicated diagrammatically as an enclosing structure 10 consisting of side walls and a top or ceiling wall. The components of the lighting system include a plurality of lighting devices 20, a plurality of radiating antennas 30 which are connected to a coaxial cable conduit 40, and an electromagnetic radio frequency power oscillator 50 located outside the structure 10. For this system, the power oscillator 50 may generate radio frequency energy in the lower frequency ranges beginning at about 13.5 mhz, for example. The lighting device 20 consists of a fluroescent lighting tube 21 which may have similarities to conventional fluorescent lighting tubes, but without any electrodes. The tube 21 may be an elongated sealed glass envelope preferably having no metallic parts, the inner surface of which is coated with a fluroescent or phosphorescent material such as calcium tungstate, zinc sulphide or zinc silicate, which emit visible light when excited. The tube also contains a gas such as mercury vapor, the molecular structure of which is capable of excitation by radio frequency electromagnetic radiation, so that the excited gas in turn activates the fluorescent material. The tube may be energized then by radio frequency electromagnetic energy which irradiates the tube from an exterior radiating device and without the need of any electrical or physical connection. In this system, utilizing the medium to high frequency mode of operation, it is important that the length of the tube 21 be equal to at least a one-quarter wave length of the generated radio frequency energy of the system. It is also important that the associated radiating element or antenna, to be described, have a length equal to at least a one-quarter wave length of the generated radio frequency energy. With this described matching of physical lengths and wave lengths, the light output from the tube will be uniform and will be maximized.

While the tube 21 is inherently safe, from the standpoint of causing an explosion, because it is cool operating and does not have any spark creating electrodes, the tube is desirably encased in an envelope or sleeve 22 of transparent plastic material for example to minimize the possibility of breakage from external impact for example. The outer envelope 22 may be closed in any suitable manner. The tube 21 may be conveniently retained within the outer envelope 22 by cushioning devices such as encircling O-rings 23. As seen in FIG. 1, the lighting devices 20 may be supported from the top wall or other surface of the structure 10 by means of a suitable bracket 24 which is electrically insulating and preferably contains no metallic parts.

Figure 3:
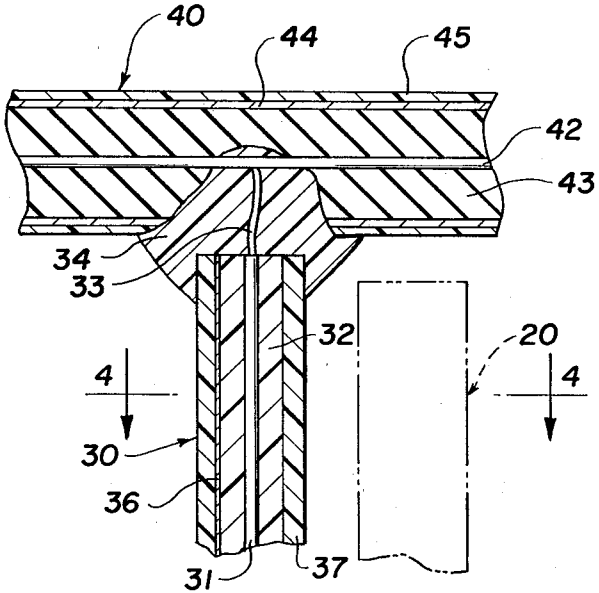
FIG. 3 is a fragmentary sectional view illustrating the connection of a radiating device to the transmission conduit in the system of FIG. 1.
Figure 2:
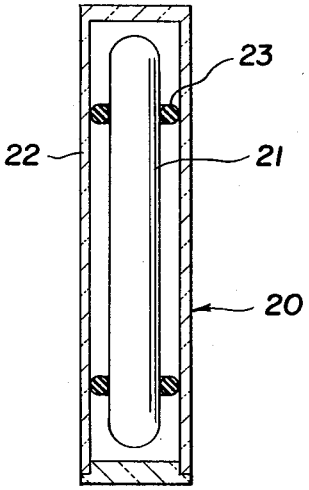
FIG. 2 is a detail view, partially in section, of a lighting device for the system of FIG. 1.

As seen in FIG. 1, the coaxial cable 40 is suspended from the top wall of the structure 10 by means of suitable insulating brackets 41, and would traverse the top wall of that structure to pass adjacent to the several lighting devices 20. As seen in FIG. 3, the coaxial cable 40 consists of a central conductor 42, heavy surrounding sleeve of core insulation 43, an outer tubular conductor 44 surrounding the core insulation, and a rugged outer insulation sleeve 45 surrounding the outer conductor preferably formed of thick plastic.

In this system, as will now be described, the outer conductor 44 is not connected electrically to any component or structure within the structure 10, but serves as a shield for the radio frequency energy transmitted by means of the central conductor 42. Accordingly, even should the outer conductor 44 be exposed through damage to the cable, there is little chance that such exposure could create a spark which might trigger an explosion within the explosion prone area.

A radiating antenna 30 is coupled to the coaxial cable adjacent to each of the lighting devices 20; and for maximum performance of the system it is important that these antennas be tapped into the coaxial cable at the high point of the current node of the generated radio frequency energy. The proximity of the antenna 30 to the lighting device 20 would be dependent on the power of the generated radio frequency energy. In a system of low power it may be desirable that the antenna 30 be very close, such as within a few centimeters, of the lighting device. The antennas 30 may be physically supported relative to the coaxial cable in any suitable manner; and it may be desirable that the antenna and lighting device be supported relative to or even contiguous to each other in any suitable manner.

As an alternative structure, it may be desirable that the antenna 30 and the lighting device 20 be so arranged as to be contained in a single housing 70, made of a transparent plastic or other transparent insulating material which completely encapsulates the antenna and the lighting device. The purpose of this encapsulating housing is to mitigate spurious radio frequency emissions; and for this purpose the housing may be coated on the inside with an optically transparent but conductive coating to shield, contain and absorb the radio frequency energy. Alternatively, conductive wires may be embedded in the walls of the housing 70 to serve the same purpose. The electrically conductive optically transparent coating, or the embedded wires in the housing walls, serve as a "Faraday shield" and contain the radio frequency energy within the housing thereby reducing or eliminating the leakage of radio frequency energy from the housings.

Further, where wires or other conductive strands are embedded in the walls of the container, or possibly secured to the interior surfaces of the container walls, these wires or strands may have a flat or strip-like geometry, with the flat surfaces of the strands oriented parallel to the direction of the emitted light in order to maximize the light output from the housing.

The antenna 30 consists of an elongated rod or tube 31 of copper for example completely enclosed, except at its coupling end, by a sleeve or coating of rugged insulating material which is of course transmissive of electro magnetic radio frequency energy. The insulating coating is to prevent the exposure of any metallic surface within the explosion prone area. At the coupling end, the antenna rod 31 is electrically connected to the center core 42 of the coaxial cable by means of a conductor lead 33; and the antenna 30 is physically supported relative to the coaxial cable in any suitable manner. To enable the coupling to the coaxial cable, a side opening is made through the outer insulation 45, the outer conductor 44 and the core insulation 43 to expose the center conductor 42; and after the coupling is made, this exposed area of the coaxial cable is entirely sealed with an electrically insulating material 34 which also seals the coupling end of the antenna 30, to assure that the lead conductor 33 is fully insulated from exposure.

Figure 4:
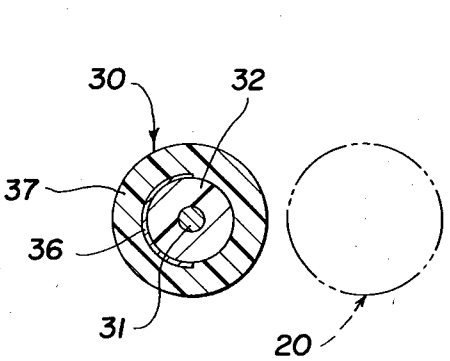
FIG. 4 is a sectional view taken along the line 4—4 of FIG. 3.

For maximum system efficiency, it is desirable that the radiation from the antenna 30 be directionalized toward the associated lighting device 20. One form of directional lighting reflector is illustrated in FIGS. 3 and 4, where the position of a lighting device 20 relative to the antenna 30 is indicated in phantom lines. For the illustrated antenna, as best seen in FIG. 4, it is assumed that the exterior surface of the insulation body 32 surrounding the rod 31 is cylindrical and concentric with the rod 31. Approximately one half of this cylindrical surface, on one side of an axial plane, is provided with a coating or layer 36 of a material which is reflective of radio frequency electromagnetic radiation, and which may or may not include metallic particles or components. The antenna, including this layer 36, is then enclosed or encapsulated by an outer insulating layer or sleeve 37 which is, of course, transmissive of radio frequency electromagnetic radiation. For maximum efficiency of this reflector, the distance between the antenna rod and the reflector may desirably be related to the wave length of the radiated waves.

The power oscillator 50 is illustrated as having an associated power supply 51, the power supply having a variable power control 52 for controlling the power of the generated radio frequency energy.

Figure 5:
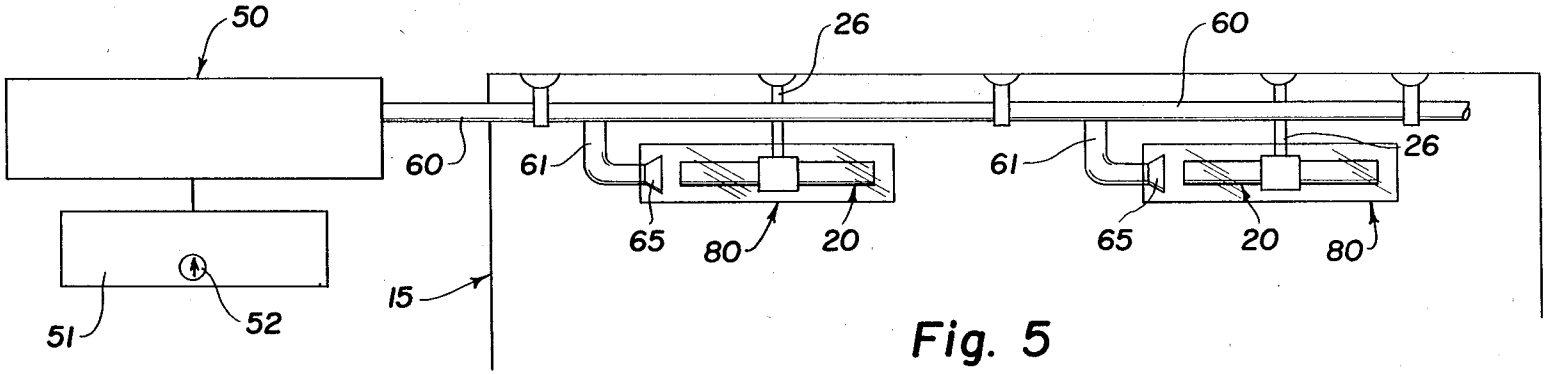
FIG. 5 is a diagrammatic view of an alternative form of lighting system according to the invention.
Figure 6:
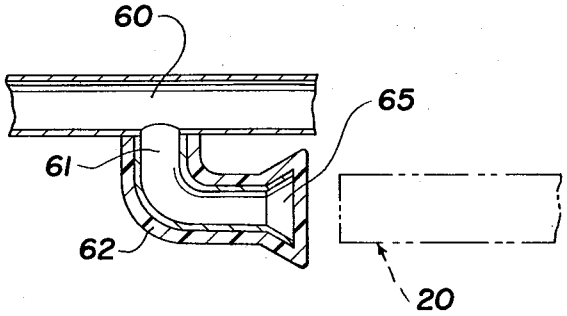
FIG. 6 is a fragmentary sectional view illustrating the connection of the radiating device to the conduit of the system of FIG. 5.

Embodiment of FIGS. 5 and 6

FIGS. 5 and 6 of the drawing are concerned with another form of system according to the invention in which radio frequency electromagnetic energy is transmitted into an explosion prone area by means of a waveguide conduit 60. In FIG. 5, an explosion prone area is again indicated diagrammatically as an enclosing structure 15 consisting of side walls and a top or ceiling wall. The components of the lighting system include a plurality of lighting devices 20 as previously described, the wave guide 60 and associated radiating devices in the form of resonant horns 65, and the electromagnetic radio frequency power oscillator 50 again located outside the structure 15. For this system, the power oscillator 50 will generate radio frequency energy in the super high frequency range for example, wherein that energy must be transmitted through suitable waveguide.

The lighting devices 20 may have the same construction previously described; and are indicated as being supported horizontally from the ceiling of the structure 15 by suitable brackets 26, again fabricated from electrically insulating material.

The waveguide 60 may be fabricated from copper tubing, either circular or rectangular in cross section, and dimensioned in accordance with the frequency of the energy to be transmitted into the explosion prone area. In this higher frequency range, it is not necessary that the radiating antenna be positioned parallel to the lighting device; and it has been found that the system works well with the radiating horn aligned axially with an elongated tubular lighting device. Also, since the wave length of the radiant energy is short relative to the length of the tube, the length of the lighting tube 21 is not so critical for efficient operation. In the illustrated system, a plurality of resonant horns 65 are associated each with respective lighting devices 20; and these resonant horns are secured to the principal waveguide transmission conduit 60 by means of branch conduits 61.

The radiating horns 65 may be completely encased or surrounded by a thick layer of an insulating material 62 which is transmissive of electromagnetic radiation, fabricated from a plastic material for example, to prevent the possibility of another metal object contacting the horn and reducing its radiation efficiency. Similarly the entire waveguide transmission conduit 60 and branch conduits 61 may be coated or otherwise protected with an insulating material for the same reason, and also to eliminate the possibility of an explosion triggering spark from metal to metal impact.

Should one of the lighting tubes 20 be broken by an external object, there is no danger of explosion since there is no internal electric arc, only excited gas molecules.

The radiating antenna for this system may be a dishshaped antenna, rather than the illustrated resonant horn antenna 65; and in either case the radiating device or antenna will radiate a concentrated field of electromagnetic energy to the lighting device 20 for efficient system operation.

Again, as an alternative construction, the resonant horn 65 and the lighting device 20 may be arranged as to be contained in a single housing 80 made of a transparent plastic or other transparent insulating material which completely encapsulates the horn and lighting device. The purpose of the housings 80 is the same as that of the housings 70 for the system of FIG. 1, namely to mitigate spurious radio frequency emissions.

In the above described systems, the coaxial cable 40 and the waveguide 60 are described as being directly connected to the power oscillator 50. It will be appreciated that the single conductor 42 of the coaxial cable or the wave guide may be dielectrically coupled to the generator 50 without a direct electrical connection. This will protect against the generator being struck by lightning, or being contacted by a power line, for example.

Method

One aspect of the present invention is a method for providing illumination in an explosion prone area; and the above described systems are examples of systems for providing such illumination according to a method which includes some or all of the following steps. At least one and preferably a plurality of lighting devices are placed at the desired locations within the explosion prone area to provide the necessary or desired illumination. The lighting devices are fabricated to include a sealed envelope which has fluorescent material on the inner wall surfaces thereof, which fluorescent material is responsive to some form of excitation such as radiation to cause it to fluoresce and produce visible light. The envelopes of the lighting devices also contain a gas which is responsive to radio frequency electromagnetic radiation to excite or activate the fluorescent material of the lighting device. Radio frequency electromagnetic energy is generated at a location remote from, or outside of, the explosion prone area; and that electromagnetic energy is transmitted into the explosion prone area by means of a suitable transmission conduit such as coaxial cable or waveguide. The transmission conduit is insulated to minimize the possibility of any electric spark created either internally, or through contact with another metal object within the explosion prone area. At least one and preferably a plurality of radiating devices are placed within the explosion prone area and connected to the transmission conduit. These radiating devices are so related to the conduit to tap into the conduit at maximum energy points for efficiency of radiation; and the radiating devices placed in physical relation to the several lighting devices to efficiently irradiate the several lighting devices with electromagnetic radiation. The radiating devices are encased or otherwise insulated with electrically insulating material which is passive to electromagnetic radiation, to prevent contact with other articles within the explosion prone area which might tend to cause a spark or intense heat. The lighting devices are excited or activated by the radiating electromagnetic energy to provide the desired illumination within the explosion prone area. All components of the system are supported within the explosion prone area in a manner to be electrically isolated from the structure which defines that explosion prone area.

What has been described is a novel method and system for providing desired illumination in explosion prone areas, where the atmosphere of such areas is inherently explosion prone because of dust, vapors, or other environmental conditions, and where the occurrence of flame, spark, or intense heat may trigger an explosion. A principal feature and advantage of the system is that there is almost no possibility of the occurrence of such flame, spark or intense heat resulting from the lighting system. Another advantage of the system is that the possibility of such flame, spark or intense heat is remote, even when the system is interfered with by elements within the explosion prone area which are not a part of the lighting system.

An important feature of the system is that the lighting devices are completely sealed, are physically independent of the energizing source in that there is no wired or other physical connection, and may be protected against breakage without significantly impairing the illumination capability.

Another important feature of the invention is that the lighting devices are capable of being excited or activated by radio frequency electromagnetic energy which may be generated and irradiated over a very wide range of frequencies; and that electromagnetic energy may be generated exterior of or remote from the explosion prone area and transmitted into the explosion prone area by suitable insulated and protected transmission conduits.

An advantage of the invention is that the system may utilize conventional fluorescent tubes with damaged electrodes, which have no further useful life in the conventional fluorescent lighting systems which require direct electrical connection to the fluorescent tubes.

While preferred embodiments of the invention have been illustrated and described, it will be understood by those skilled in the art that changes and modifications may be resorted to without departing from the spirit and scope of the invention.

What is claimed is:

1. A method for providing illumination within an area having an atmosphere which is explosion prone when exposed to spark, flame or intense heat, including the steps fabricating lighting devices which include a sealed envelope having fluorescent material on the inner wall surfaces thereof responsive to radiation, the envelope containing a gas responsive to radio frequency electromagnetic radiation to activate the fluorescent material to provide visible light;

placing at least one of said lighting devices in said explosion prone area;

generating radio frequency electromagnetic energy at a location outside of said explosion prone area;

transmitting said radio frequency electromagnetic energy into and within said explosion prone area through transmission conduit means;

connecting at least one electromagnetic energy radiating device to said conduit means within said explosion prone area; enclosing said radiating device with a radiation passive, electrically insulating material;

placing one of said radiating devices adjacent to but spaced from each of said lighting devices; and irradiating each of said lighting devices by means of an adjacent radiating device to energize said lighting devices.

2. A method as set forth in claim 1 including the step electrically insulating said transmission conduit means within said explosion prone area.

3. A method as set forth in claim 1 including the step supporting said lighting devices within said explosion prone area with electrically insulating support means.

4. A method as set forth in claim 1 including the step enclosing each of said lighting devices with a radiation passive, impact resistant, translucent enclosure.

5. A method as set forth in claim 1 including the steps transmitting said radio frequency electromagnetic energy into said explosion prone area through a coaxial cable;

insulating said coaxial cable with an exterior layer of electrically insulating material.

6. A method as set forth in claim 5 including the steps connecting a radiating antenna to said coaxial cable in the form of an elongated metal member electrically connected to the central conduit of said coaxial cable;

enclosing said elongated radiating antenna with radiation passive, electrically insulating material; and sealing the connection between said coaxial cable and said radiating antenna with an electrically insulating material.

7. A method as set forth in claim 6 including the steps fabricating said lighting devices in the form of elongated sealed envelopes of a selected length;

fabricating said elongated antenna to a selected length; and mounting said lighting devices in side by side relation to a radiating antenna.

8. A method as set forth in claim 7 including the step selecting the lengths of said lighting devices and said radiating antennas to be about one-quarter the wave length of the generated radio frequency electromagnetic energy.

9. A method as set forth in claim 1 including the step transmitting said radio frequency electromagnetic energy to said explosion prone area through a waveguide.

10. A method as set forth in claim 9 including the step connecting to said waveguide at least one radiating device in the form of a resonant horn.

11. A method as set forth in claim 10 including the steps fabricating said lighting devices in the form of elongated sealed envelopes; and mounting said elongated lighting devices relative to said resonant horns to be aligned generally linearly with the radiation radiating from said horns.

12. A method as set forth in claim 1 including the step encapsulating said radiation device and said associated lighting device in a light transparent housing defining a shield to inhibit leakage of radio frequency energy.

13. A lighting system for illuminating an area having an atmosphere which is explosion prone when exposed to spark, flame or intense heat, said system comprising at least one lighting device disposed in said explosion prone area, each comprising a sealed envelope having a radiation responsive fluorescent material on its interior wall surface, and containing a gas responsive to radio frequency electromagentic radiation to activate said fluorescent material;

generating means for generating radio frequency electromagnetic energy, disposed outside said explosion prone area;

transmission means for transmitting radio frequency electromagentic energy from said generating means into and within said explosion prone area;

at least one electromagnetic energy radiating device connected to said transmission means within said explosion prone area; said radiating device and the connection between said radiating device and said transmission means being encased in radiation passive, electrically insulating material;

one of said radiating devices being disposed within said explosion prone area adjacent to but spaced from each one of said lighting devices.

14. A system as set forth in claim 13 including said transmission means being electrically insulated within said explosion prone area.

15. A system as set forth in claim 13 including electrically insulating support means for supporting said lighting devices within said explosion prone area.

16. A system as set forth in claim 13 including each lighting device including an impact resistant, radiation passive enclosure.

17. A system as set forth in claim 13 including said transmission means comprising a coaxial cable having an exterior layer of electrically insulating material.

18. A system as set forth in claim 17 including said radiating devices comprising radiating antennas consisting of elongated metal members enclosed within a radiation passive electrically insulating material; and the connections between said coaxial cable and said radiating antennas being sealed with an electrically insulating material.

19. A system as set forth in claim 18 including said lighting devices being formed from elongated envelopes having a length corresponding to the length of said radiating antennas; said lighting devices and said radiating antennas being supported in adjacent side-by-side relationship.

20. A system as set forth in claim 19 said generating means generating energy at a wave length about four times the length of said radiating antennas and lighting devices.

21. A system as set forth in claim 13 including said transmission means comprising waveguide conduit.

22. A system: as set forth in claim 21 including said radiating devices including resonant horns connected to said waveguide.

23. A system as set forth in claim 22 including said envelopes of said lighting devices being elongated and tubular; and said elongated tubular lighting devices being mounted in generally linear alignment with the radiation radiating from said resonant horns.

24. A system as set forth in claim 13 including said radiation device and said associated lighting device being encapsulated in a light transparent housing defining a shield to inhibit leakage of radio frequency energy.

* * * * *